US009624776B2

(12) United States Patent
Chandramohanan et al.

(10) Patent No.: US 9,624,776 B2
(45) Date of Patent: Apr. 18, 2017

(54) REDUCED STRESS SUPERBACK WHEEL

(71) Applicant: BorgWarner Inc., Auburn Hills, MI (US)

(72) Inventors: Rajmohan T. Chandramohanan, Fletcher, NC (US); Paul K. Anschel, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 344 days.

(21) Appl. No.: 14/397,757

(22) PCT Filed: Apr. 22, 2013

(86) PCT No.: PCT/US2013/037534
§ 371 (c)(1),
(2) Date: Oct. 29, 2014

(87) PCT Pub. No.: WO2013/165716
PCT Pub. Date: Nov. 7, 2013

(65) Prior Publication Data

US 2015/0104317 A1 Apr. 16, 2015

Related U.S. Application Data

(60) Provisional application No. 61/642,016, filed on May 3, 2012.

(51) Int. Cl.

| | |
|---|---|
| ***F01D 5/02*** | (2006.01) |
| ***F01D 5/04*** | (2006.01) |
| ***F01D 5/14*** | (2006.01) |

(52) U.S. Cl.
CPC ..... *F01D 5/048* (2013.01); *F01D 5/025* (2013.01); *F01D 5/141* (2013.01); *F05D 2220/40* (2013.01); *F05D 2230/232* (2013.01)

(58) Field of Classification Search
CPC ..... F01D 5/025; F01D 5/048; F01D 5/141; F05D 2220/40; F05D 2230/232
See application file for complete search history.

(56) References Cited

U.S. PATENT DOCUMENTS 4,538,969 A * 9/1985 Ammann ..... F01D 5/025 416/244 A
4,787,821 A * 11/1988 Cruse ..... B23K 20/021 228/118
4,850,802 A * 7/1989 Pankratz ..... F01D 5/02 228/113
4,863,349 A * 9/1989 Arkhipov ..... F04D 29/284 416/186 R
4,944,660 A 7/1990 Joco
6,012,901 A * 1/2000 Battig ..... F01D 5/025 416/244 A
6,164,931 A * 12/2000 Norton ..... F04D 29/266 29/889.2

(Continued)

FOREIGN PATENT DOCUMENTS

JP 63198702 8/1988

*Primary Examiner* — Igor Kershteyn
(74) *Attorney, Agent, or Firm* — A. Michael Tucker; Stephan A. Pendorf; Patent Central LLC

(57) ABSTRACT

Turbocharger turbine wheels are designed to accelerate rapidly and to rotate at very high RPM. A turbine wheel is provided with improved low cycle fatigue resistance. The wheel can be balanced by conventional methods.

10 Claims, 2 Drawing Sheets

(56) References Cited

U.S. PATENT DOCUMENTS

| | | | | |
|---|---|---|---|---|
| 6,481,970 | B2 * | 11/2002 | Mukherjee | F04D 25/04 416/204 A |
| 6,994,526 | B2 * | 2/2006 | Furman | B23P 9/00 416/244 A |
| 7,040,867 | B2 * | 5/2006 | Louthan | F01D 5/025 416/244 A |
| 7,281,901 | B2 | 10/2007 | Garman et al. | |
| 8,641,380 | B2 * | 2/2014 | McKenzie | C21D 7/04 416/185 |
| 2008/0063528 | A1 | 3/2008 | Seiler | |
| 2010/0003132 | A1 | 1/2010 | Holzschuh | |

* cited by examiner

REDUCED STRESS SUPERBACK WHEEL

FIELD OF THE INVENTION

The invention relates to stress reduction in a wheel designed to accelerate rapidly and to rotate at very high RPM, such as a turbine wheel of a turbocharger.

BACKGROUND OF THE INVENTION

Turbochargers extract energy from a vehicle exhaust to drive a compressor to deliver air at high density to the engine intake, allowing more fuel to be combusted, thus boosting the engine's horsepower. Tighter regulation of engine exhaust emissions has led to an interest in boost devices capable of delivering ever higher pressure ratios. One way to achieve this is to drive the compressor wheel at higher tip speeds, typically translating to 80,000 RPM to 300,000 RPM, depending upon the diameter of the compressor wheel. Not only high rotational speeds, but also shaft forces to rapidly accelerate the compressor wheel, create high tensile loading of the compressor wheel. This loading is especially severe particularly near the bore. It is conventional to reinforce the backwall of a compressor wheel with a central bulge.

Compared to a compressor wheel, a turbine wheel is usually made of a higher value alloy, able to withstand the high temperatures and corrosive gasses to which the turbine wheel is exposed. The turbine wheel also differs from a compressor wheel in the manner of joining to the shaft, i.e., while a compressor wheel typically has a through-going bore by which it is seated on a shaft, and is fixed to the shaft via a nut, a turbine wheel is solid and is materially fixed to the shaft, e.g., by welding or brazing. Turbine wheel backwalls also differ from compressor wheel backwalls. Turbine wheels backwalls are conventionally substantially flat. See US Patent Application 2010/0003132 (Holzschuh) assigned to the assignee of the present application, which forms the basis for FIGS. 1 and 2.

Since the turbine wheel and compressor wheel are fixed to the same shaft, the turbine wheel must spin at the same high RPM as the compressor wheel. The turbine wheel is also subjected to repetitive stresses and can experience low cycle fatigue failure. There is thus a need to further guard against the possibility of low cycle fatigue failure in turbine wheels.

The commercial turbocharger industry is cost driven. While there is a need to reduce to low cycle fatigue failure, this objective must be accomplished economically, i.e., without resort to high cost measures such as multiple-alloy wheel manufacturing techniques, exotic alloys, five-axis milling from billet, time-consuming cold-working to remove surface defects, etc.

It has recently been discovered that compressor wheels provided with a slightly longer, profiled hub end have improved life against low cycle fatigue. Compressor wheels with this design have been referred to as "superback". To accommodate the added length of the superback compressor wheel, the industry found the need to redesign other associated features of the turbocharger such as flinger and diffuser.

Although there are significant structural, metallurgical, and joining differences between compressor wheels and turbine wheels, the present inventors investigated wither increased hub length could also provide benefits to turbine wheels with regard to prevention of low cycle fatigue. Since turbine housings are generally designed to receive turbine wheels with flat backs, and since it is conventional practice to balance turbine wheels by removing material from a flat region of the backwall, there was a question as to how to design a "superback" turbine wheel to, on the one hand, possibly provide the desired benefit, and on the other hand, cause the minimum disruption to the industry, e.g., allow the industry to continue with conventional balancing processes, and to incorporated into the available line of turbine housing with minimum re-design and re-engineering of cooperating turbocharger components.

An initial turbine wheel superback design provided a generally conical transition between an elongated weld hub and the flat backwall of the turbine wheel (FIG. 2). This turbine wheel superback design was tested commercially and was found to meet expectations. The present inventors nevertheless investigated to see whether even greater improvements could be achieved. The inventors considered different alloys, mechanical surface treatments, chemical surface treatments, coatings, heat treatments and other options.

SUMMARY OF THE INVENTION

Surprisingly, it was discovered that further improving turbine wheel resistance to low cycle fatigue lie not in complex, cost-adding conventional techniques, but in a further refinement of the overall superback design. With this seemingly small change, it became possible, without additional expense, to provide a turbine wheel that could continue to be easily balanced by conventionally available techniques, yet be less susceptible to stress and low cycle fatigue failure.

The invention is achieved by a turbocharger turbine wheel having a superback backwall characterized by a conical region between a weld hub and a flat backwall region, wherein the superback backwall is defined, in cross-section, by a triangle of which the sides are formed by lines derived from the axis of rotation (1), the planar region of the backwall (L1) and the line describing the surface of the cone (L2), wherein the line describing the surface of the cone (L2) intersects the line defining the planar region of the backwall (L1) at a point between 50% and 90% of the distance between shaft axis (1) and turbine wheel outer diameter, wherein the length of the side of the triangle derived from the axis of rotation is at least 2% of the diameter of the turbine wheel, wherein the transition between the conical region and the flat backwall region is described by an arc having a radius corresponding to at least 10% of the diameter of the turbine wheel, preferably at least 15% of the diameter of the wheel, most preferably between 20 and 30% of the diameter of the turbine wheel.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

Figure 1:
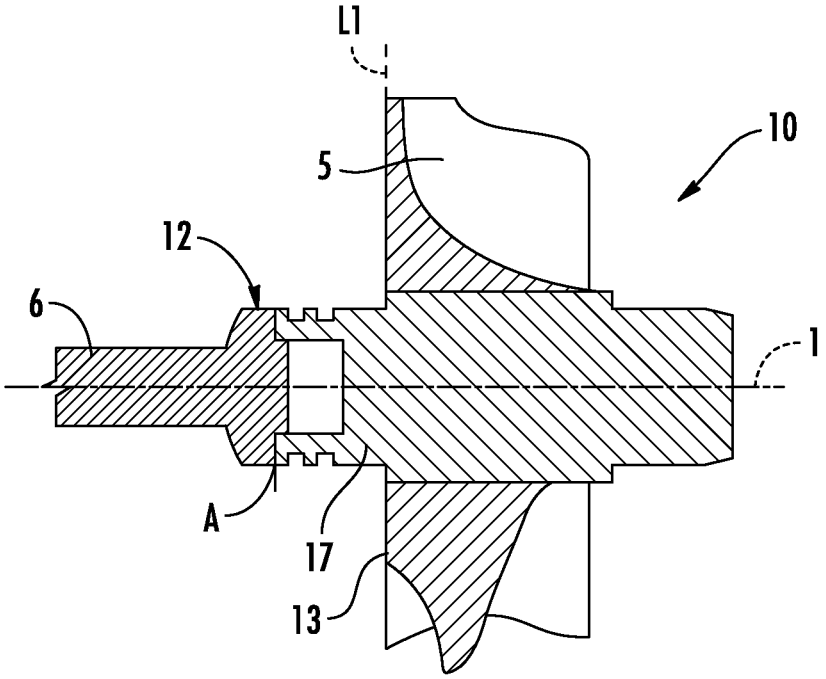
FIG. 1 PRIOR ART
FIG. 1 depicts a section of a typical rotating assembly.

A conventional turbine wheel (10) is shown in cross section in FIG. 1. Between the backwall (13) of the wheel and the junction (A) between shaft (6) and wheel (10) is a journal or weld boss (17). The wheel is fused to a shaft (6) at junction (A) to form a shaft-and-wheel assembly which rotates about an axis (1).

Radial inlet flow turbine wheels can be classified into "scalloped backwall" (wherein some hub material is removed from between blades to reduce inertia of the turbine wheel) and "full backwall" (wherein no hub material is removed, providing greater efficiency). The additional material of the full backwall disk however causes elevated stress on the backface of the turbine. These increased stresses can cause a measurable reduction in the low cycle fatigue lifetime, reducing the lifetime below that required in a typical commercial diesel application. The present invention provides the greatest benefit to the full backwall turbine wheel, but can also be applied to scalloped backwall turbine wheels.

The invention can also be applied to mixed flow (wherein flow impinges the turbine wheel radial and axial) turbine in which the backwall and hub does not extend all the way to the tip diameter.

File FIG. 1 shows a scalloped back turbine wheel, the upper half of FIG. 1 is a cross section at a point where the backwall is full, thus could represent a fullback. The lower half of FIG. 1 shows a cross section through the scalloped area.

A turbine wheel can be identified as a "superback" in accordance with the present invention if the backwall reinforcement is designed based on the principle of a cone (with surface in cross section defined by a line) rather than a bell (with cross section forming a continuous curve). More specifically, viewed in cross section, an extended line along the conventional planar region of the turbine wheel backwall is defined as line L1. The conical reinforced section of the backwall is defined by a second line L2. The shaft axis defines a third line. To be a superback, the length of the side of the triangle along the shaft axis must be at least 2%, preferably 2-10%, most preferably 3-6% of the diameter of the turbine wheel.

Line L2 intersects L1 at a point between 50% and 90%, preferably between 55% and 75%, most preferably between 60% and 70% of the way from shaft axis to wheel outer diameter.

In accordance with the present invention, the line L2 transitions into line L1 along an arc having a radius corresponding to at least 10% of the diameter of the turbine wheel, preferably at least 15% of the diameter of the wheel, most preferably between 20 and 30% of the diameter of the wheel.

Turning back to FIG. 1, blades (5) are provided on the hub away from the backwall (13). It is apparent that the backwall is substantially planar, with no reinforcing conical section characteristic of the inventive superback design.

Figure 2:
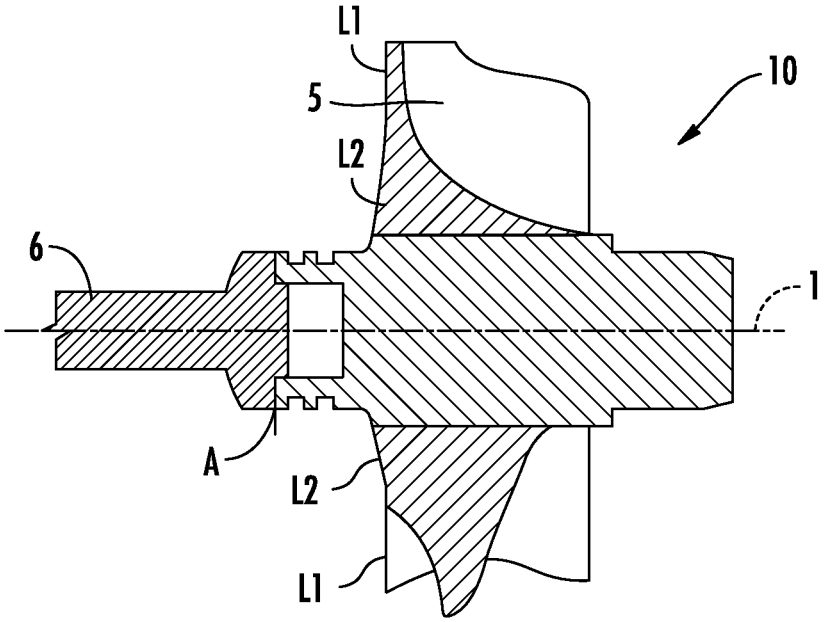
FIG. 2 depicts a superback backwall that has not been modified in accordance with the invention.

FIG. 2 shows a superback backwall that has not been modified in accordance with the present invention. The transition between L1 and L2 is defined by an arc with radius having a length of less than 5% of the diameter of the backwall.

Figure 3:
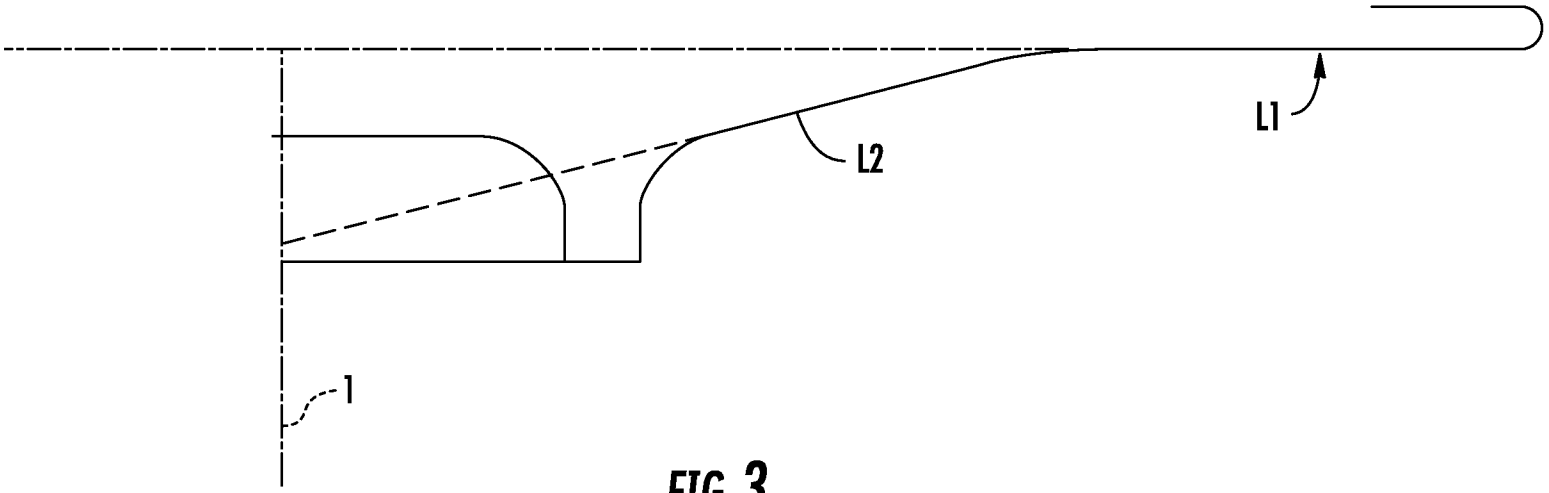
FIG. 3 depicts a rotating assembly with backwall modified according to the invention.

FIG. 3 shows schematically the triangle formed by the three lines (1), L1 and L2. FIG. 3 differs from FIG. 2 in that line L1 transitions into line L2 along an arc with a radius corresponding to at least 10% and at most 40% of the diameter of the turbine wheel, preferably at least 15% and at most 35% of the diameter of the turbine wheel, most preferably 20-30% of the diameter of the turbine wheel.

The minimum amount of "flat" backwall corresponding to line L1 is the amount that will provide a surface for balancing operations.

Optionally, the turbine wheel may have a datum ring cast into the backface of the turbine wheel. The axially projecting surface of the datum ring, facing away from the turbine wheel blades, is used geometrically to axially locate the rotating assembly aerodynamics (compressor and turbine wheels) in the desired place in the compressor cover and turbine housing, so it is a critical surface. However, the inventive turbine wheel does not require a datum ring.

Now that the invention has been described,

We claim:

1. A turbocharger turbine wheel having a superback backwall characterized by a conical reinforced region and a flat backwall region, wherein the transition between the conical region and the flat backwall region is described by an arc having a radius corresponding to at least 10% of the diameter of the turbine wheel.

2. The turbocharger turbine wheel as in claim 1, wherein the transition between the conical region and the flat backwall region is described by an arc having a radius corresponding to at least 15% of the diameter of the turbine wheel.

3. The turbocharger turbine wheel as in claim 1, wherein the transition between the conical region and the flat backwall region is described by an arc having a radius of between 20 and 30% of the diameter of the turbine wheel.

4. The turbine wheel as in claim 1, wherein the superback backwall is defined, in cross-section, by a triangle of which the sides are formed by lines derived from the axis of rotation (1), the planar region of the backwall (L1) and the line describing the surface of the cone (L2), and wherein the line describing the surface of the cone (L2) intersects the line defining the planar region of the backwall (L1) at a point between 50% and 90% of the distance between shaft axis (1) and turbine wheel outer diameter.

5. The turbine wheel as in claim 1, wherein the superback backwall is defined, in cross-section, by a triangle of which the sides are formed by lines derived from the axis of rotation (1), the planar region of the backwall (L1) and the line describing the surface of the cone (L2), and wherein the line describing the surface of the cone (L2) intersects the line defining the planar region of the backwall (L1) at a point between 55% and 75% of the distance between shaft axis (1) and turbine wheel outer diameter.

6. The turbine wheel as in claim 1, wherein the superback backwall is defined, in cross-section, by a triangle of which the sides are formed by lines derived from the axis of rotation (1), the planar region of the backwall (L1) and the line describing the surface of the cone (L2), and wherein the line describing the surface of the cone (L2) intersects the line defining the planar region of the backwall (L1) at a point between 60% and 70% of the distance between shaft axis (1) and turbine wheel outer diameter.

7. The turbine wheel as in claim 1, wherein the superback backwall is defined, in cross-section, by a triangle of which the sides are formed by lines derived from the axis of rotation (1), the planar region of the backwall (L1) and the line describing the surface of the cone (L2), and wherein the length of the side of the triangle derived from the axis of rotation is at least 2% of the diameter of the turbine wheel.

8. The turbine wheel as in claim 7, wherein the length of the side of the triangle derived from the axis of rotation is between 2% and 10% of the diameter of the turbine wheel.

9. The turbine wheel as in claim 7, wherein the length of the side of the triangle derived from the axis of rotation is between 3% and 6% of the diameter of the turbine wheel.

10. The turbine wheel as in claim 1, wherein the backwall is a fullback.

* * * * *